United States Patent [19]

Sherrill

[11] 4,338,972

[45] Jul. 13, 1982

[54] PIVOTAL SUPPORT WITH POSITIVE STOP WARP STOP-MOTION

[76] Inventor: John B. Sherrill, Hickory Grove Rd., Gastonia, N.C. 28052

[21] Appl. No.: 129,105

[22] Filed: Mar. 10, 1980

[51] Int. Cl.[3] ..... D03D 51/28

[52] U.S. Cl. ..... 139/369

[58] Field of Search ..... 139/353, 358, 369; 66/163

[56] References Cited

U.S. PATENT DOCUMENTS

| | | | |
|---|---|---|---|
| 1,793,147 | 2/1931 | Wakefield | 139/358 |
| 1,873,214 | 8/1932 | Payne | 139/358 |
| 2,858,857 | 11/1958 | Picanol | 139/369 |
| 3,421,552 | 1/1969 | Sotek | 139/358 |

*Primary Examiner*—Henry Jaudon

*Attorney, Agent, or Firm*—Clifton T. Hunt

[57] ABSTRACT

The invention comprises a fully adjustable and pivotal support for a warp stop-motion which may be finely adjusted to its optimum operable position and then pivoted upwardly and out of the way when desired, as while changing the warp beam, and instantly and accurately retured to said optimum operating position by means of a positive stop which positions the warp stop-motion mechanism in said optimum operative position automatically without further attention by the operator except to tighten the few bolts necessary to hold the warp stop-motion mechanism in said optimum operating position.

5 Claims, 7 Drawing Figures

FIG. 1
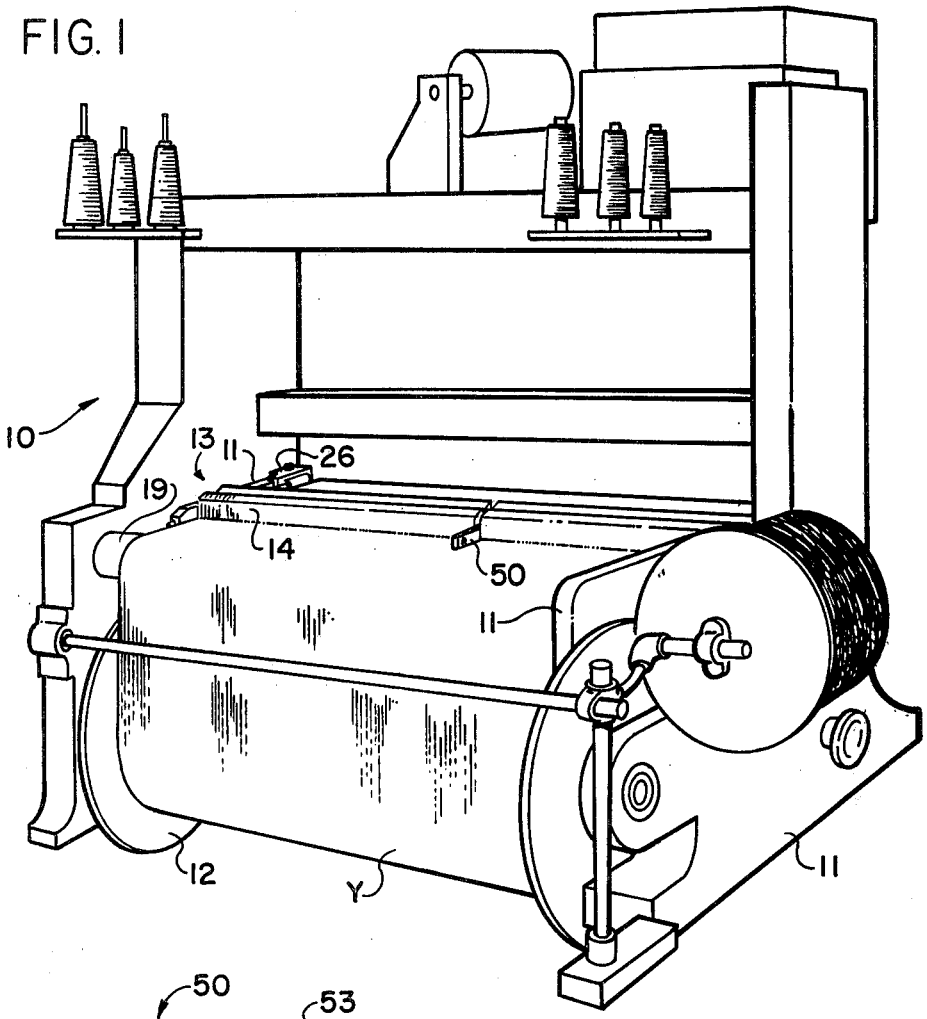
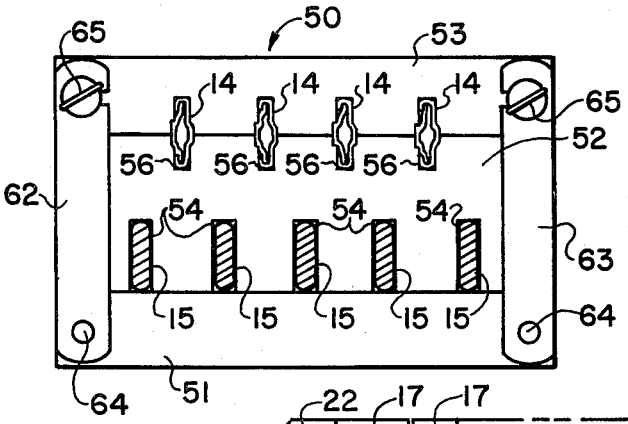
FIG. 6
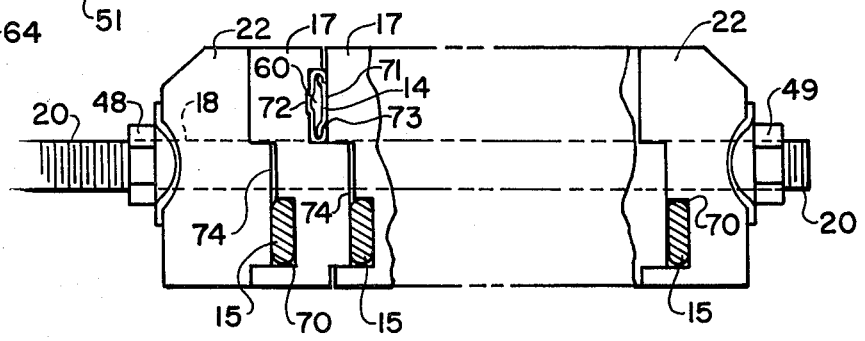
FIG. 7

PIVOTAL SUPPORT WITH POSITIVE STOP WARP STOP-MOTION

BACKGROUND OF THE INVENTION

Electric warp stop-motions are well known in the weaving trade. Their function is to stop the loom when the warp thread breaks. Toward this end, as is well known in the art, as each warp thread leaves the warp beam and passes over the whip roll, it is passed through a drop wire which is an integral part of the electric stop-motion. The electric stop-motion is positioned between the warp beam and the heddles in the harness mechanism which forms the shed. Electric warp stop-motions have long been known and need not be described as the support mechanism of this invention is useful with any desired electric warp stop-motion utilizing drop wires and electrodes.

As is well known throughout the trade, the positioning of the warp stop-motion device is critical to the grain or the appearance of the fabric. It is therefore of great importance to provide means for rapidly and accurately shifting or adjusting the warp stop-motion device longitudinally and laterally of the loom and vertically, as desired. Prior attempts to provide a suitable support for electric warp stop-motion devices are shown in U.S. Pat. No. 2,858,857 issued Nov. 4, 1958 to Jaime Picanol, U.S. Pat. No. 3,421,552 issued Jan. 14, 1969 to Stanley J. Sotek, U.S. Pat. No. 3,584,659 issued June 15, 1971 to Erwin Pfarrwaller, and U.S. Pat. No. 3,358,718 issued Dec. 19, 1967 to Harold J. Bager, et. al.

The support mechanisms of the prior art are satisfactory to permit adjustments of the warp stop-motion device longitudinally and laterally of the loom and also vertically, but the time required to make the adjustments is objectionable and it is objectionable to need to make adjustments after the stop-motion mechanism is moved to work on the loom or replace a warp beam.

In recent years, loom operating speed have increased tremendously and the size of the warp beam has correspondingly increased in order to provide a larger supply of yarn and reduce the number of times the warp beam had to be replaced during operation of the high speed loom.

In certain prior art support mechanisms for electric stop-motion devices it is necessary to remove the stop-motion mechanism in order to replace the new enlarged warp beam and it is consequently necessary to readjust the position of the warp stop-motion mechanism when said mechanism is reinstalled on the loom after the warp beam has been changed. This results in considerable down time for the loom with a consequent loss of production.

SUMMARY OF THE INVENTION

The present invention includes means for quickly and accurately adjusting the position of the warp stop-motion mechanism to any desired location by manipulating it longitudinally, laterally, and vertically relative to the loom. Additionally, the warp stop-motion mechanism is supported by means of the present invention in cantilever fashion from the frame of the loom in such a manner that the stop-motion mechanism may be manually pivoted upwardly and then mechanically held out of the way when desired, as when changing a warp beam of the present large diameter. The support mechanism of the present invention may be manually lowered back into its original optimum operating position automatically without attention by the operator except to tighten the few bolts necessary to hold it in that position during operation of the loom.

It is an object of this invention to provide a support mechanism for electric warp stop-motion mechanisms which supports the stop-motion mechanism in pivoted cantilever fashion from the loom frame, and which includes a positive stop for automatically reestablishing the desired location of the warp stop-motion mechanism after it has been purposefully moved out of the way.

It is a further object of the invention to provide support means for a warp stop-motion mechanism, which support means provides firm rigid support for the elongated and fragile components of the mechanism to restrict vibration and thereby increase its useful life.

It is a still further object of the invention to provide support means for a warp stop-motion, which support means comprises components which are individually replaceable when necessary instead of having to replace the entire support unit.

BRIEF DESCRIPTION OF THE DRAWINGS

FIG. 1 is a somewhat schematic perspective view looking at the rear and one side of a weaving loom and illustrating one approximate relative positioning of the warp beam and the electric stop-motion mechanism;

FIG. 6 is a vertical sectional view taken substantially along the line 6—6 in FIG. 2; and FIG. 7 is a vertical sectional view taken substantially along the line 7—7 in FIG. 2.

DETAILED DESCRIPTION OF THE INVENTION

Figures 2, 5:
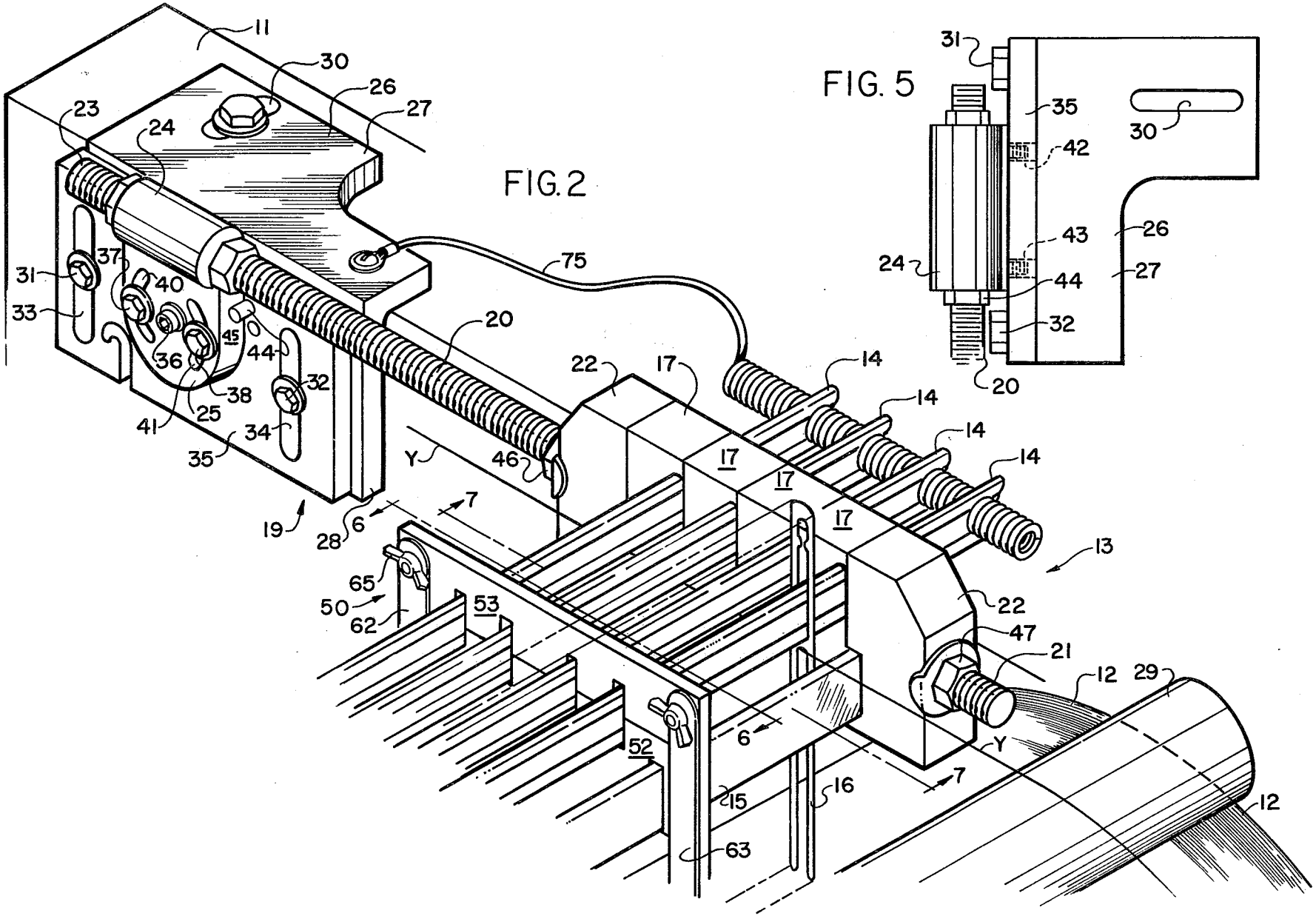
FIG. 2 is an enlarged perspective view, with parts broken away, illustrating the attachment of the support assembly according to the invention on one side of the loom and operatively connected with the electric stop-motion mechanism.
FIG. 5 is a top plan view of the support assembly shown in FIG. 2, removed from the loom.

Referring more specifically to the drawings, a weaving loom generally designated by the reference numeral 10 includes a frame 11 which supports a warp beam 12 extending transversely across the rear of the loom 10. Individual ends of warp yarn, only one of which is indicated at Y for purposes of illustration, are drawn from the warp beam 12, across a whip roll 19 and through a stop-motion mechanism broadly indicated at 13 enroute to the weaving instrumentalities, not shown, on the loom 10.

The stop-motion mechanism 13 includes a drop wire 14 for each warp yarn Y supported about electrodes 15 and between separator bars 16. The electrodes 15 and separator bars 16 extend transversely across the rear of the loom and are supported between spacer blocks 17, there being a block 17 of desired thickness between adjacent electrodes 15 and separator bars 16 (FIG. 7) to maintain them in desired spaced relation. Each spacer block 17 has an opening 18 therethrough to slidably receive a threaded rod 20 having a free end 21 over which the blocks 17 are threaded preparatory to clamping the electrodes 15 and separator bars 16 between the blocks 17. End blocks 22 are also threaded on the threaded rods 20 to support the outermost and innermost electrodes and separator bars.

A threaded rod 20 is provided at each side of the loom 10 and includes a fixed end 23 received for longitudinal adjustment in a tubular extension 24 of a pivot bracket 25.

It will be understood that the rod 20, tubular extension 24 and pivot bracket 25 are components of a support assembly broadly indicated at 19 and that there is a support assembly 19 of the same instruction on each side of the loom 10 and that the following description of the support assembly 19 illustrated in the drawings on one side of the loom is equally applicable to the support assembly on the other side of the loom.

Figure 3:
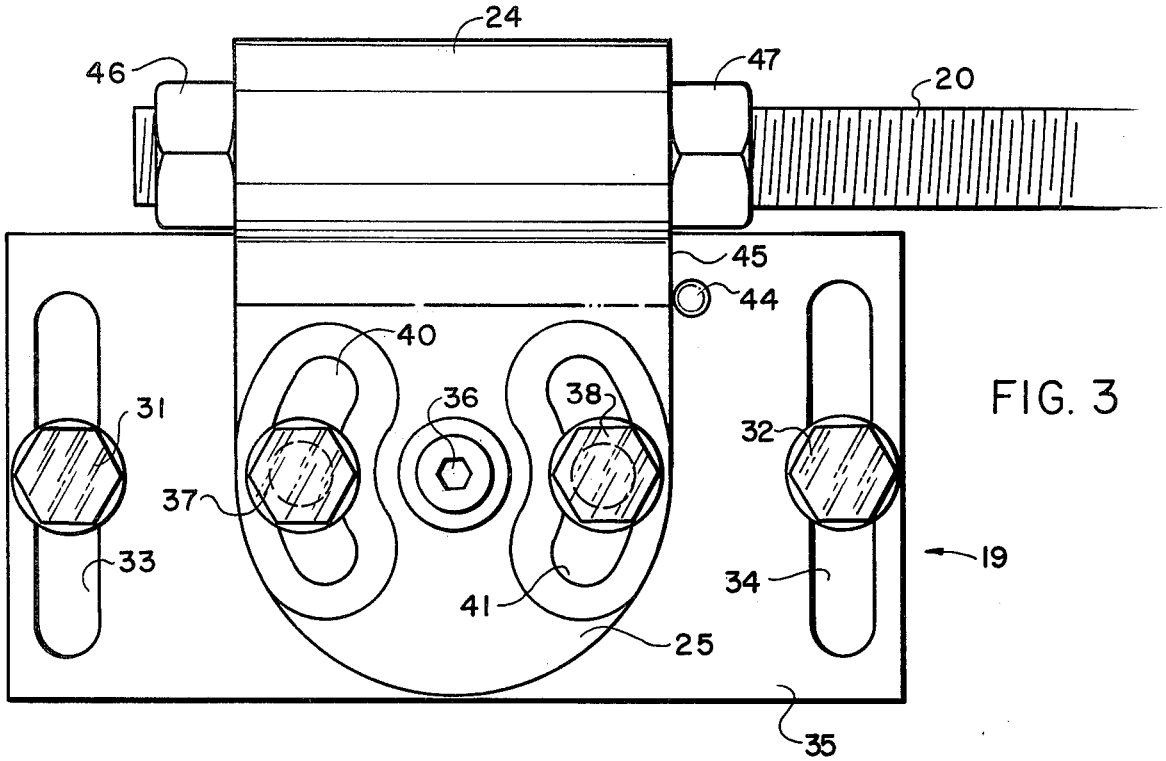
FIG. 3 is a side elevation of the support assembly shown in FIG. 2 in operative position and bearing against the positive stop pin.

The support assembly 19 for the stop-motion mechanism 13 comprises an L-shaped angle bracket 26 including a horizontally disposed plate 27 and a vertically disposed plate 28. The horizontal plate 27 has a transversely extending slot 30 through which a bolt 31 loosely passes and is secured to the frame 11 of the loom 10. The vertical plate 28 of bracket 26 has a pair of threaded bores, not shown which threadably engage bolts 31 and 32 extending through vertical slots 33 and 34 in a mounting plate 35. The pivot bracket 25 is journaled on the mounting plate 35 by a pivot pin 36 extending through the axis of the pivot plate 25. The pivot bracket 25 is freely pivotal about pin 36 relative to mounting plate 35, but may be supported in raised position by adjustment of bolts 37 and 38 which loosely penetrate arcuate slots 40 and 41 through pivot bracket 25 and are threadably retained in threaded bores 42 and 43 (FIG. 5) in mounting plate 35. The pivot bracket 25 is primarily supported in its intended operative position by an abutment or stop 44 projecting laterally inwardly from the mounting plate 35 for engagement by the proximal edge 45 of pivot bracket 25 when it is in the operative postion of FIGS. 2 and 3.

Figure 4:
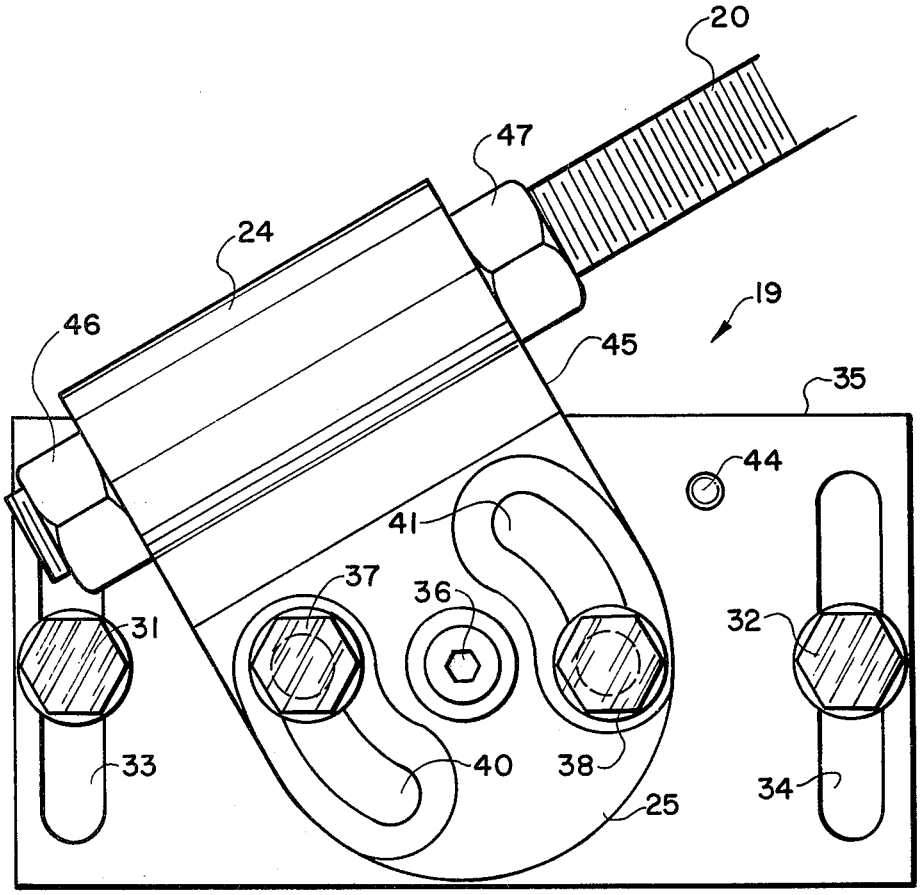
FIG. 4 is a view similar to FIG. 3 but showing the support assembly pivoted away from the positive stop pin to elevate the stop-motion device.

The bolts 37 and 38 may be loosened when desired to elevate the stop-motion mechanism 13 and the pivot bracket 25 may be rotated within the limit of the arcuate slots 40, 41 as shown in FIG. 4, after which the bolts 37, 38 may be tightened to retain the threaded rods 20 and the stop-motion mechanism 13 in an elevated position out of the way while work is carried out on the loom as by replacing the warp beam 12. When it is desired to reposition the stop-motion mechanism 13 in its operative position, the bolts 37, 38 are loosened to permit the pivot bracket 25 to rotate to the right in FIGS. 3 and 4 until the edge 45 engages the fixed abutment 44, thereby automatically returning the stop-motion mechanism 13 to its predetermined optimum operating position.

The predetermined optimum operating position of the stop-motion mechanism 13 is achieved through manipulation of the various provisions for adjustment on the novel support assembly 9. The threaded rods 20 permit an infinite adjustment of the stop-motion mechanism 13 longitudinally of the loom within a broad range, by manipulation of the nuts 46 and 47, and the vertical slots 33, and 34 in the mounting plate 35 permit vertical adjustment of the stop-motion mechanism 13, while transverse adjustment of the positioning of the stop-motion mechanism 13 is accomplished through transverse manipulation of the horizontal plate 27 of angle bracket 26 by loosening the bolts which hold the plate 27 on the loom frame 11.

Referring to FIG. 7, it will be observed that each of the spacer blocks 17 is shaped to snugly clamp the electrodes 15 and separator bars 16 when the end member 22 are moved toward each other by manipulation of the nuts 48 and 49 adjacent the innermost and outermost end pieces 22.

Additional support for the medial portion of the electrodes 15 and separator bars 16 is provided by a bridge 50 located at about the mid-point of the electrodes 15 and separator bars 16 between the sides of the loom. The bridge 50 comprises a base plate 51, an intermediate spacer plate 52 and a top spacer plate 53 (FIG. 6). The base plate 51 is shown as being of rectangular configuration while the intermediate spacer plate 52 has notches 54 communicating with its lower edge 55 and spaced and shaped to receive separator bars 16. The notches 54 are dimensioned to tightly receive the separator bars to minimize movement of the bars resulting from the normal vibration of the loom. As best seen in FIG. 6, the lower edge of the separator bars 16 rests on the upper surface 58 of base plate 51. The intermediate separator plate 52 also has a plurality of notches 56 communicating with its upper edge 57 to receive the electrodes 15.

The electrodes 15 may each have a stiffening rib 60 extending longitudinally along one side and the notches 56 are cut to such a depth in the plate 52 that with the electrodes 15 fully seated in their respective notches 56 the ribs 60 on the electrodes substantially coincide with the upper edge 57 of plate 52. The upper stabilizing plate 53 has corresponding notches 61 formed in its lower edge and communicating therewith to receive the upper portions of the electrodes 15 seated in notches 56 in intermediate plate 52. The three plates 51, 52, and 53 are held together by metal straps 62 and 63, the straps 62 and 63 being anchored to the base plate 51 as by bolts 64 and to the top plate 53 as by bolts 65.

The separator blocks 17 and the end blocks 22 are each shaped to define chambers for the reception of the electrodes 15 and separator bars 16. As most clearly seen in FIG. 7, each block 17 has a chamber 70 in its lower portion slightly less than the thickness of the separator bar 16 received in the chamber 70, and a chamber 71 in its upper portion to receive an electrode 15. The chamber 71 includes an arcuate recess 72 to accommodate the rib 60 on electrode 15 and the chamber 71 is slightly less than the thickness of the rib 15 so that the rib protrudes beyond the chamber 71 to bear against a straight wall 73 of the adjoining spacer block 17. In like manner, the separator bars 16 project beyond their respective chamber 70 to bear against a straight wall 74 on the adjacent separator block 17. Note that the outermost end block 22 has a chamber 70 for a separator bar 16 while the innermost end block 22 has a straight wall 74 bearing against the separator bar 16 in the chamber 70 of the adjoining separator block 17.

Arranged in this manner, the electrodes 15 and separator bars 16 are held rigidly in place when the nuts 46 and 47 on the threaded bars 20 are tightened to press the blocks 17 and 22 tightly against the electrodes 15 and separator bars 16. This rigid clamping practically eliminates wear of the electrodes and separator bars which normally occurs due to loom vibration.

The electrodes 15 are electrically connected to a source of electricity and grounded by wires 75 connected to springs 76 which easily and conveniently fit into notches in the ends of the electrodes 15.

There is thus provided an improved support assembly for the electric stop-motion mechanism of a weaving loom, which support assembly includes means for adjusting the mechanism longitudinally, transversely and vertically to achieve the optimum operating position, means for quickly, pivoting the stop-motion mechanism out of the way when desired to perform routine or repair operations on the loom without disturbing the warp yarns in the drop wires, and means for automatically repositioning the stop-motion assembly at its said predetermined optimum operating position without further attention by the operator.

Although specific terms have been used in describing the invention they are used in a descriptive sense only and not for purpose of limitation.

I claim:

1. In a loom having a frame, a warp beam and a stop-motion mechanism through which ends of yarn extend from the warp beam, a support assembly extending between said stop-motion mechanism and the frame of the loom, said support assembly including a pivotal bracket journaled for pivotal movement relative to the frame and operatively connected to the stop-motion mechanism, said support assembly including means for locating the stop motion mechanism in an optimum operating position and means for pivoting the stop-motion mechanism away from the loom and out of optimum operating position, and a fixed abutment located in the path of travel of the pivotal bracket during its pivotal movement relative to the frame to engage and support the pivotal bracket with the stop-motion mechanism in operative position.

2. A structure according to claim 1 wherein said support assembly includes a pair of threaded rods spaced laterally from each other and means operatively attaching the threaded rods to the frame on opposite sides of the loom, said stop-motion mechanism including a plurality of spacer blocks on each of said threaded rods, a plurality of the elongated electrodes and a plurality of the elongated separator bars extending transversely of the loom and positioned between the spacer blocks, and means for exerting pressure on the spacer blocks to clamp the electrodes and separator bars firmly between the spacer blocks.

3. In a loom having a frame, a warp beam and a stop-motion mechanism through which ends of warp yarn extend from the warp beam, a support assembly extending between said stop-motion mechanism and the frame of the loom, said support assembly including means for locating the stop-motion mechanism in an optimum operating position, means for pivoting the stop-motion mechanism away from the loom and out of said optimum operating position, means for relocating the stop-motion mechanism at the said optimum operating position, said support assembly comprising a pair of angle brackets each including horizontal plate and vertical plate and the vertical plate in each said angle bracket having a transversely extending slot, means penetrating the said transversely extending slots in the angle brackets and connecting the angle brackets to the frame on opposite sides of the loom with the vertical plates of the angle brackets opposed to each other in facing relation, a pair of mounting plates each having a pair of vertically extending slots therethrough and means extending through said slots for attaching one of said mounting plates to each vertical plate of the angular brackets, a pivotal bracket attached to each mounting plate, the pivotal brackets being opposed to each other on opposite sides of the loom and each including an axially located pivot pin fixed to its respective mounting plate and a pair of arcuately extending slots spaced radially on opposite sides of the pivot pin, a bolt loosely penetrating each said arcuate slot and threadably engaged in the mounting plate, each pivot bracket including a tubular extension formed integral therewith and extending upwardly therefrom, a threaded rod slidably received within each tubular extension, said rods extending from their respective tubular extensions in spaced parallel relation on opposite sides of the loom and each threaded rod having a free end remote from its respective tubular extension, a stop-motion mechanism depending from the free ends of the threaded rods, and means for adjusting the lineal distance of the stop-motion mechanism from the tubular extensions.

4. A structure according to claim 3 wherein said stop-motion mechanism comprises a plurality of separator blocks each having a passageway extending through its mid portion in substantially parallel relation to the longitudinal axis of the loom to slidably receive one of said threaded rods, each spacer block having a chamber in its upper portion to receive an electrode and a chamber in its lower portion to receive a separator bar, the chambers for the electrodes and the separator bars in said spacer blocks being less than the width of their respective electrodes and spacer bars so that the electrodes and spacer bars project beyond their respective chambers, and a flat surface on the adjacent spacer bar bearing against the electrodes and spacer bars, and means exerting pressure on said spacer bars to rigidly clamp the electrodes and spacer bars in assembled relation.

5. In a loom having a frame, a warp beam and a stop-motion mechanism through which ends of warp yarn extend from the warp beam, a support assembly extending between said stop-motion mechanism and the frame of the loom, said support assembly including a pair of mounting plates, means connecting the mounting plates to the frame on opposite sides of the loom in opposed facing relation to each other, means enabling vertical adjustment of the mounting plates relative to the loom, a pivotal bracket attached to each mounting plate, the pivotal brackets being opposed to each other on opposite sides of the loom, means mounting the pivotal brackets for limited pivotal movement relative to their respective mounting plates, a stop-motion mechanism depending in space relation from the pivotal brackets and movable with the pivotal brackets in and out of operative position, means for adjusting the spacing of the stop-motion mechanism relative to the pivotal brackets, and a fixed abutment located in the path of travel of a pivotal bracket during its pivotal movement relative to the frame and engageable in supporting relation with the pivotal bracket to support the stop-motion mechanism in operative position.

* * * * *

UNITED STATES PATENT AND TRADEMARK OFFICE

CERTIFICATE OF CORRECTION

PATENT NO. : 4,338,972

DATED : July 13, 1982

INVENTOR(S) : John B. Sherrill

It is certified that error appears in the above-identified patent and that said Letters Patent is hereby corrected as shown below:

Column 3, line 13, "instruction" should read -- construction --.

Column 3, line 58, "9" should read -- 19 --.

Signed and Sealed this

Twenty-first Day of December 1982

[SEAL]

*Attest:*

GERALD J. MOSSINGHOFF

*Attesting Officer*

*Commissioner of Patents and Trademarks*